US009997143B2

(12) United States Patent
Skutt

(10) Patent No.: US 9,997,143 B2
(45) Date of Patent: Jun. 12, 2018

(54) CAPO

(71) Applicant: Grover Musical Products, Inc., Cleveland, OH (US)

(72) Inventor: Dann W. Skutt, Cleveland, OH (US)

(73) Assignee: Grover Musical Products, Inc., Cleveland, OH (US)

( * ) Notice: Subject to any disclaimer, the term of this patent is extended or adjusted under 35 U.S.C. 154(b) by 45 days.

(21) Appl. No.: 15/172,679

(22) Filed: Jun. 3, 2016

(65) Prior Publication Data

US 2016/0284327 A1 Sep. 29, 2016

Related U.S. Application Data

(63) Continuation of application No. 14/509,690, filed on Oct. 8, 2014, now Pat. No. 9,368,091.

(60) Provisional application No. 61/943,006, filed on Feb. 21, 2014.

(51) Int. Cl.
*G10D 3/04* (2006.01)

(52) U.S. Cl.
CPC ..... *G10D 3/043* (2013.01)

(58) Field of Classification Search
CPC ..... G10D 3/043; G10D 3/08
See application file for complete search history.

(56) References Cited

U.S. PATENT DOCUMENTS 4,143,576 A 3/1979 Nichols et al.
4,475,433 A 10/1984 Williamson et al.
4,583,440 A 4/1986 Powell
D365,118 S 12/1995 Kyser
D372,259 S 7/1996 Kyser
D378,825 S 4/1997 Dunlop
6,008,441 A 12/1999 Steinberger
D521,048 S 5/2006 Steinberger
D533,211 S 12/2006 Kyser
D573,173 S 7/2008 Jackson
D573,629 S 7/2008 Steinberger
D585,479 S 1/2009 Campling
7,511,208 B1 3/2009 Kyser
7,745,710 B2 * 6/2010 Campling ..... G10D 3/043 84/312 R
7,939,736 B2 5/2011 Campling
D705,344 S 5/2014 Kyser
D717,367 S 11/2014 Kyser
(Continued)

FOREIGN PATENT DOCUMENTS

JP 2010145998 7/2010

*Primary Examiner* — Kimberly Lockett
(74) *Attorney, Agent, or Firm* — Hahn Loeser & Parks, LLP

(57) ABSTRACT

A capo for use with a stringed instrument, said capo comprising: an upper arm member including an upper handle having a dimension W2, an upper connection part, and a string press bar with an attached upper pad for engaging the strings of a stringed instrument, the string press bar having a dimension W4, W4 being greater than W2; a lower arm member including a lower handle at one end, a securing bar to engage a neck of a stringed instrument at a second end, and a lower connection part between the one end and the second end, the upper connection part connected to the lower connection part; and a spring disposed between said upper arm member and said lower arm member, said spring biasing the string press bar and the securing bar toward each other.

19 Claims, 10 Drawing Sheets

(56) References Cited

U.S. PATENT DOCUMENTS

| | | | | | |
|---|---|---|---|---|---|
| D768,233 | S | * | 10/2016 | Campling | G10D 3/043 D17/20 |
| 2007/0143929 | A1 | | 6/2007 | Selin | |
| 2011/0036229 | A1 | * | 2/2011 | Chen | G10D 3/043 84/318 |

* cited by examiner

CAPO

CROSS-REFERENCE TO RELATED APPLICATIONS

This application is a continuation of U.S. patent application Ser. No. 14/509,690 filed on Oct. 8, 2014, which claims priority to and the benefit of U.S. Provisional Application Ser. No. 61/943,006 filed Feb. 21, 2014, the disclosures of which are incorporated herein in their entirety by reference.

BACKGROUND

This relates to capos for stringed instruments, such as guitar, banjo or another stringed instrument.

A capo is a device for clamping the strings of a guitar or other stringed instrument against a neck of the instrument to change their pitch. Shown in FIG. 1 is a type of known capo that has a string press bar 1 connected to an extension arm 2 including a handgrip 4. The extension arm 2 is connected to a positioning clamp 3. A spring 5 biases the extension arm 2 and the position claim 3 relative to one another. When a force is exerted upon the handgrip 4 and upon an end of the clamp 3, the spring 5 can be compressed to open the space between the string press bar 1 and another end of the position clamp 3. When in use, a capo is clamped onto the neck of a guitar or other stringed instrument. During use, a capo may be moved or after use, removed from a guitar or other stringed instrument.

SUMMARY

In one embodiment, a capo is provided, for use with a stringed instrument. The capo comprising an upper arm member including an upper handle, which may be curved, having a dimension W2, an upper connection part, and a string press bar. Attached to the string press bar is an attached upper pad for engaging the strings of a stringed instrument. The string press bar has a dimension W4 where W4 can be greater than W2, which is the dimension of the upper handle. The capo further comprises a lower arm member including a lower handle at one end, and a securing bar to engage a neck of a stringed instrument at a second end. Between the lower handle and the securing bar is a lower connection part. The lower connection part has a connection with the upper connection part. Disposed between the upper arm member and the lower arm member is a spring. The spring operates to bias the string press bar and the securing bar toward each other, and may be an arm spring. The securing bar may be narrower than the string press bar. The string press bar may extend beyond the securing bar in at least one direction generally perpendicular to the clamping direction of the capo.

The securing bar may have a lower pad attached, and a pad stop. The securing bar may also have ribs to assist in attaching the lower pad. Further, the lower handle may have a spring attachment point. The arm extension may extend to cover the coils of the spring disposed between the upper arm member and the lower arm member. The upper connection part and the lower connection part may be connected by a pivot. The pivot connecting the upper and lower connection parts may be a rivet.

In another embodiment, a capo is provided, for use with a stringed instrument. The capo comprising an upper arm member including an upper handle, which may be curved, having a dimension W2, an upper connection part, and a string press bar. Attached to the string press bar is an attached upper pad for engaging the strings of a stringed instrument. The string press bar has a dimension W4 where W4 can be greater than W2, which is the dimension of the upper handle. The capo further comprises a lower arm member including a lower handle at one end, and a securing bar to engage a neck of a stringed instrument at a second end. The securing bar may a removable lower pad. The securing bar may be formed with a plurality of ribs to assist in securing a removable lower pad. Between the lower handle and the securing bar is a lower connection point to enable connection to the upper connection part. This connection forms a connection point by the nesting of the upper and lower connection points. Disposed between the upper arm member and the lower arm member is a spring. The spring operates to bias the string press bar and the securing bar toward each other, and may be an arm spring.

DETAILED DESCRIPTION

Figure 1:
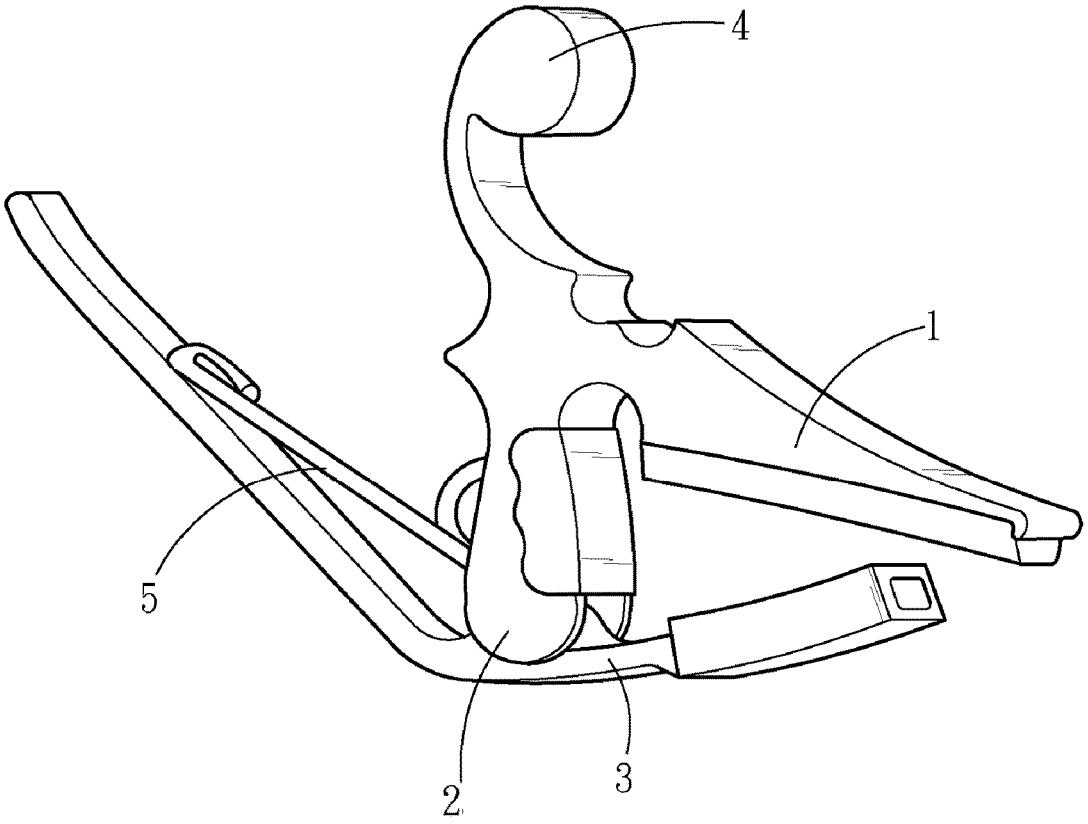
Fig. 1 PRIOR ART
FIG. 1 is a perspective view of a known capo.
Figure 2:
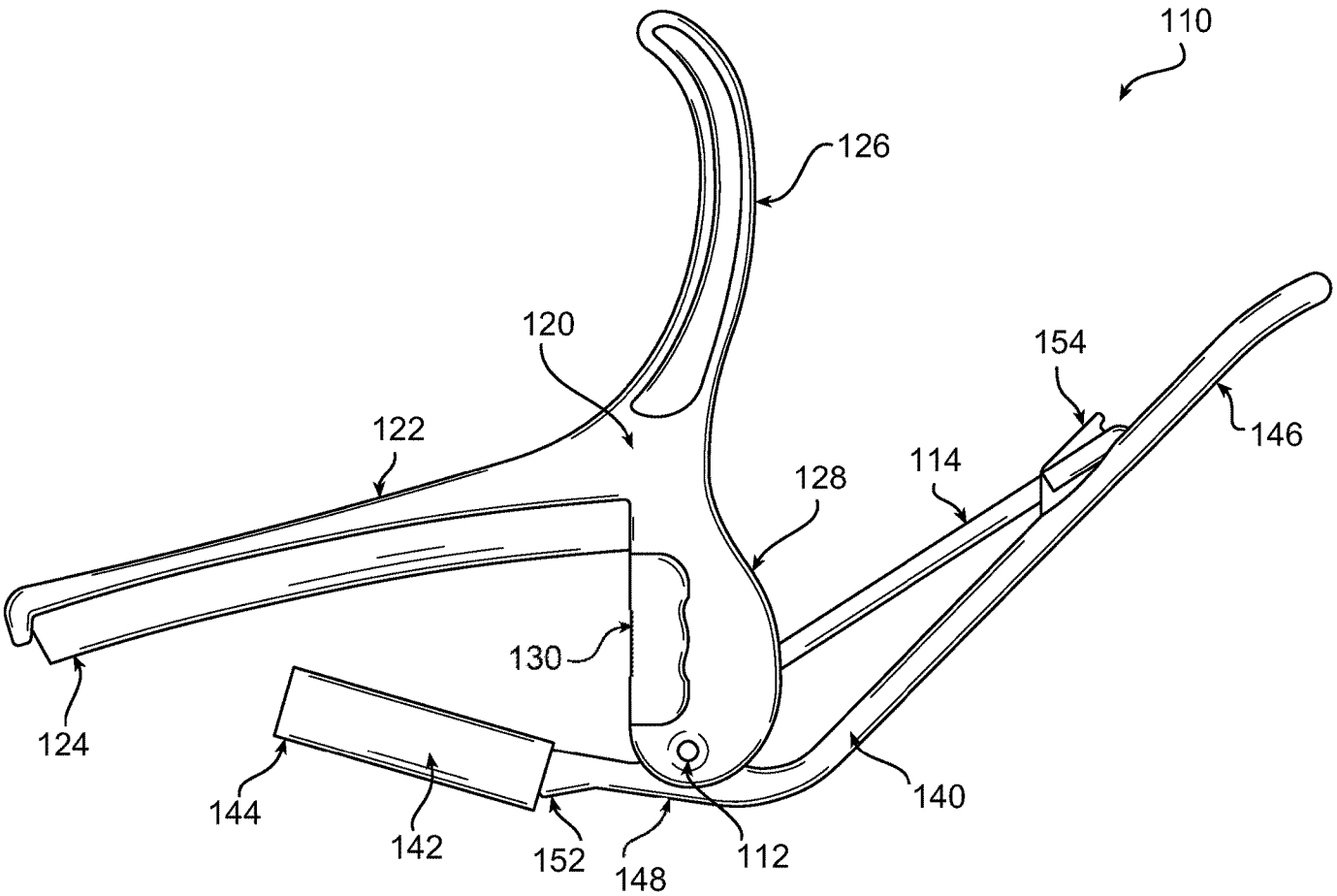
FIG. 2 is a side elevation of a capo in accordance with a first embodiment.
Figure 3:
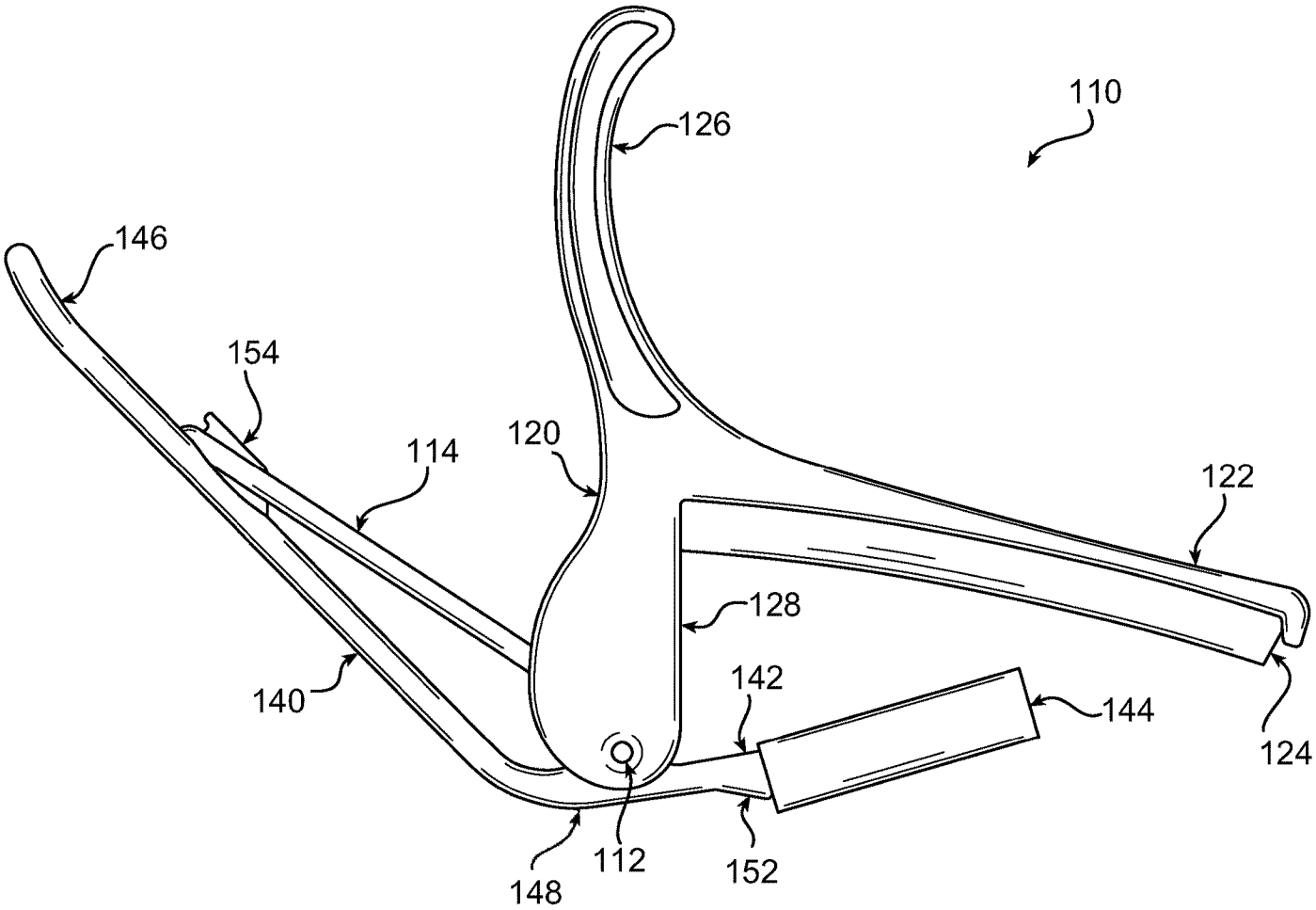
FIG. 3 is a side perspective view of a capo in accordance with another embodiment.
Figure 4:
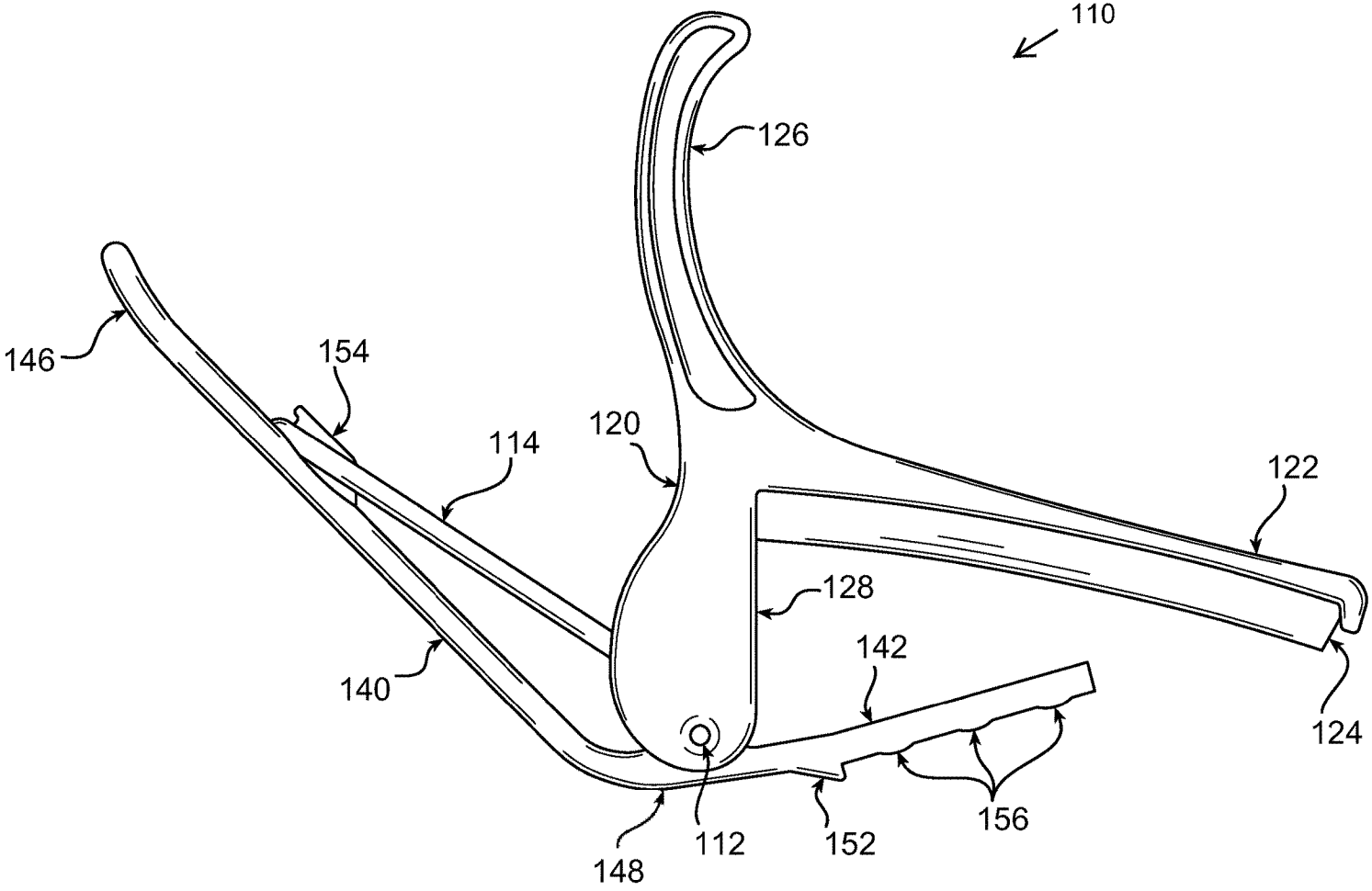
FIG. 4 is a side perspective view of the capo of FIG. 2 with the pad removed from the securing bar of the lower arm member.

Referring to FIGS. 2-6, this embodiment provides a capo 110. There is an upper arm member 120. A string press bar 122 is attached to the upper arm member 120. An upper pad 124 is attached to the string press bar 122. An upper handle 126 is attached to the upper arm member 120. An upper connection part 128 is attached to the upper arm member 120. A neck pad 130 is attached to the upper connection part 128. The upper arm member 120 is connected to a lower arm member 140. A securing bar 142 is attached to the lower arm member 140. A lower pad 144 is secured to the securing bar 142. A pad stop 152 attached to securing bar 142. A lower handle 146 is attached to the lower arm member 140. A spring attachment point 154 attached to lower handle 146. A spring 114 engages upper arm member 120 and lower arm member 140.

The upper arm member 120 and the lower arm member 140 are connected by a connection point 112. The connection point 112 includes an upper connection part 128 and a lower connection part or point disposed on the upper and lower arm members respectively. The upper connection part 128 and lower connection point operate in combination during the use of the capo 110, and together form connection point 112. The connection point 112 can be a pivot such that the upper arm member 120 and the lower arm member 140 are pivotably connected about the connection point 112. The pivot may be a shaft, bolt, rivet or other component, which allows rotation about an axis.

A biasing component is connected between upper arm member 120 and lower arm member 140. The biasing component may be the spring 114. The spring 114 may be an arm spring, preferably a torsion spring, that engages the upper arm member 120 and the lower arm member 140. The spring 114 is biased inward in order to urge the string press bar 122 and the securing bar 142 together about the connection point 112. The spring 114 has two ends.

The mechanism by which the string press bar 122 may attach to upper arm member 120 includes being a continuous formed component, or some other manner of attachment for example being attached by a bolt, a screw, or with an adhesive.

Figure 5:
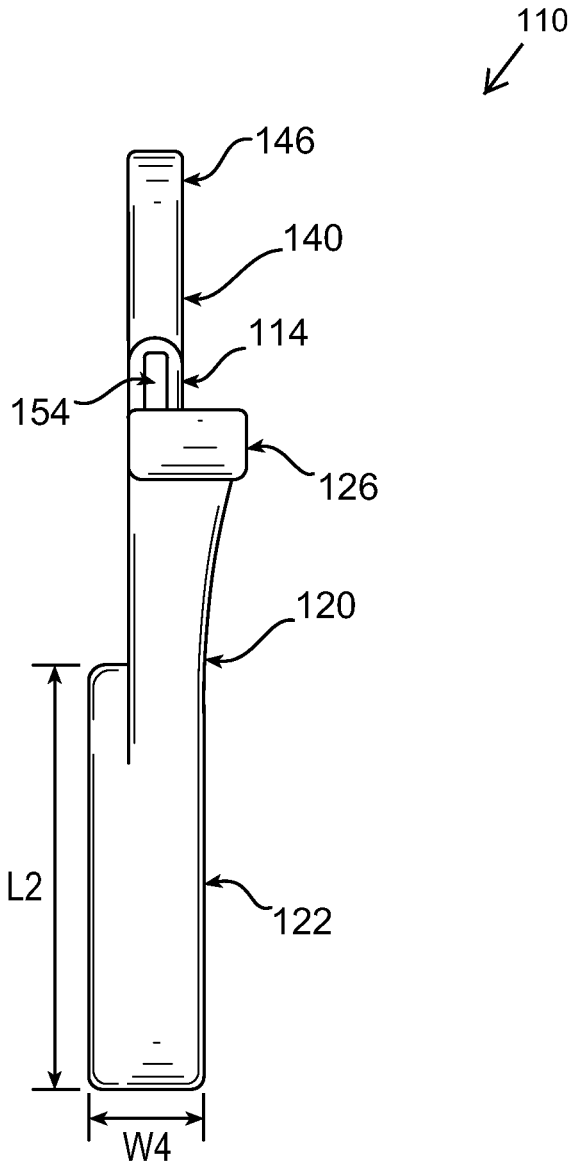
FIG. 5 is a top perspective view of the capo of FIG. 2.
Figure 6:
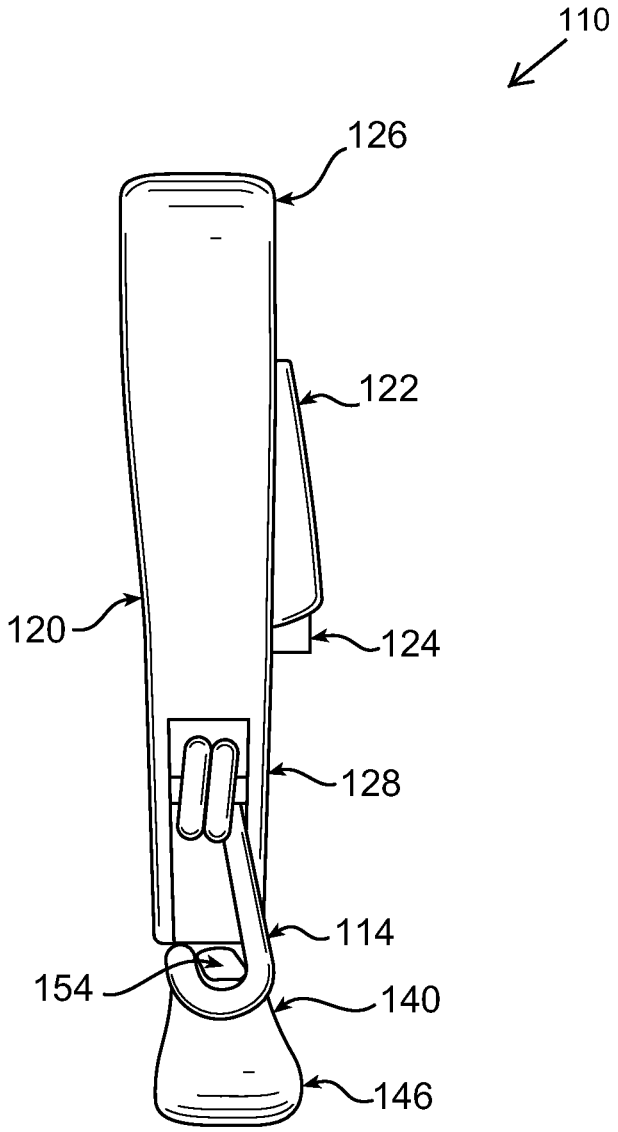
FIG. 6 is a rear perspective view along the length of the lower arm member of the capo of FIG. 2.
Figure 7:
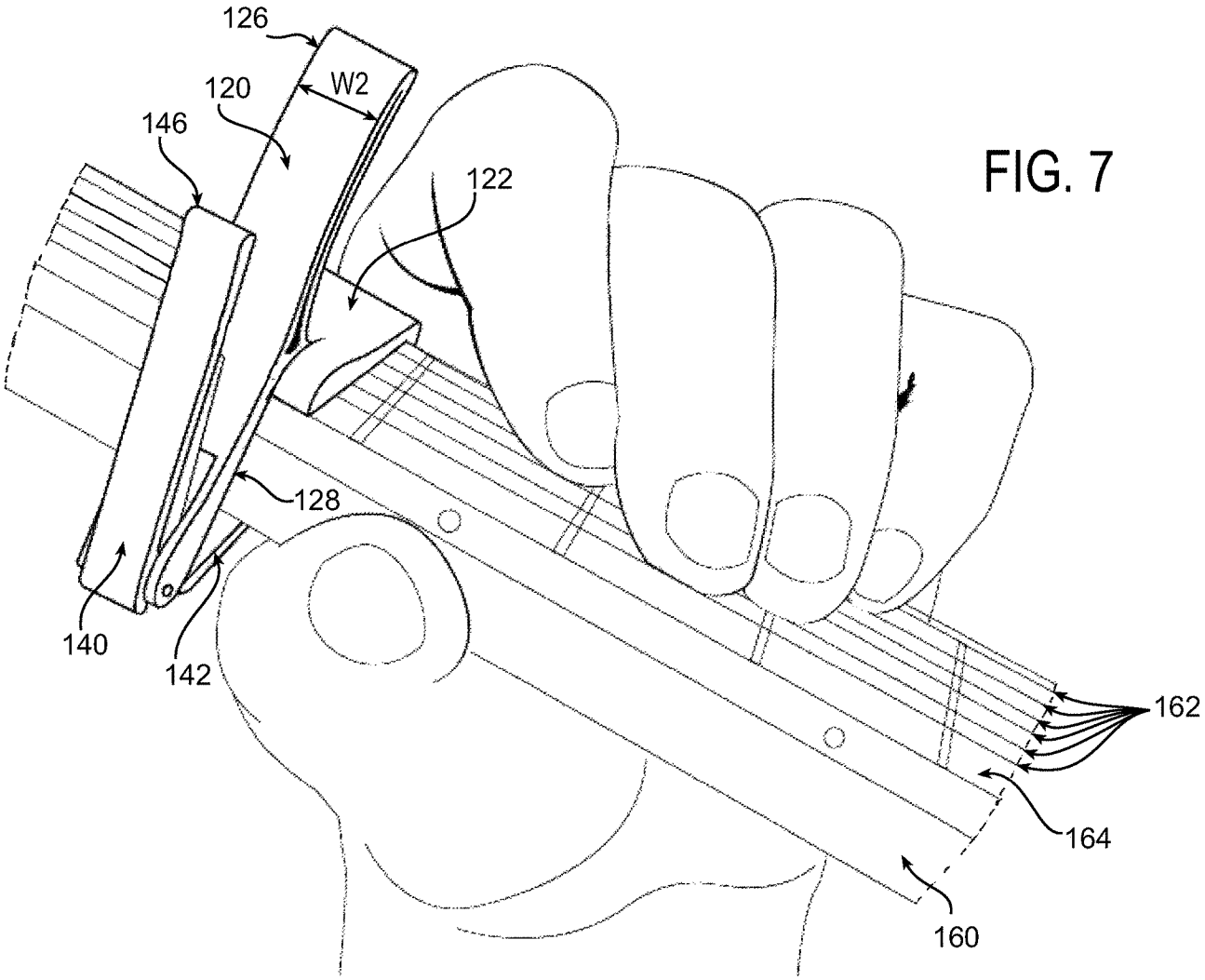
FIG. 7 is a perspective view of a capo in accordance with a further embodiment in an operational configuration attached to the neck of a stringed instrument.

In one embodiment shown in at least FIGS. 5-7, the string press bar 122 of the upper arm member 120 has a dimension W4. Dimension W4 is preferably chosen to be any dimension greater than the largest extent of dimension W2. The dimension W2 is the dimension of a substantial remainder of the upper arm member 120 and/or lower arm member 140, excluding the string press bar 122. The dimension W2 can remain constant or vary as long as its maximum extent remains less than the dimension W4. The string press bar has a length L2. The dimension W4 of string press bar 122 may be constant or vary along its length L2. The dimension W4 can terminate at the point of attachment with the upper handle 126 or it can extend beyond the point of attachment with the upper handle 126 as shown in FIG. 6. The string press bar 122 can be any length L2 at least sufficient to engage at least one string 162 of an associated stringed instrument. The upper connection part 128 may extend to cover any spring coils of spring 114.

The upper pad 124 may be attached to string press bar 122 with any suitable fastener system and/or an adhesive. The upper pad 124 extends approximately the entire length of the string press bar 122 or at least a length sufficient to protect the neck of a stringed instrument. The upper pad 124 may have a width W4 approximately equivalent to the width W4 of the string press bar 122. The upper pad 124 may also function to prevent any undesirable interaction between the capo 110 and the at least one string 162. The upper pad 124 may be made of materials such as felt, an elastomeric material or any other suitable material.

The upper handle 126 of the upper arm member 120 may be curved to aid in its use.

Additionally, the upper handle 126 may take on various forms of ornamentation. Further, the upper handle 126 may contain one or more grooves to reduce weight and/or conserve materials as desired. In use, the upper handle 126 assists in accepting a force, in conjunction with lower handle 146, to compress the spring 114 thus pivoting the upper arm member 120 or lower arm member 140 relative to the other about the connection point 112. The compression of spring 114 allows at least one arm member to pivot about the connection point 112 such that the area of the space between them increases.

The lower arm member 140 includes a securing bar 142. An optional lower pad 144 may be attached to the securing bar 142. A pad stop 152 is attached to the securing bar 142. A lower handle 146 is attached to the lower arm member 140. A spring attachment point 154 is attached to the lower handle 146. The securing bar 142 may include ribs 156 and/or a pad stop 152 to prevent movement of the lower pad 144.

The lower pad 144 may be attached to securing bar 142 with any suitable fastener system and/or an adhesive. The lower pad 144 may be made of an elastomeric material or any other suitable material. The lower pad 144 may be a sleeve of material able to encase the securing bar 142 of the lower arm member 140.

One end of the spring 114 is secured to the spring attachment point 154. The spring attachment point 154 may be attached to the lower handle 146. A second end of spring 114 may be disposed or attached within the upper arm member 120. The lower handle 146 may be curved to aid in its use. Further, the lower handle may take on other various forms of ornamentation. In use, a force applied to upper handle 126 and lower handle 146 compresses the spring 114 and urges the securing bar 142 away from string press bar 122.

Additionally, the spring attachment point 154 may be located on the lower handle 146 or at any location in order to facilitate proper operation of a capo 110.

In one embodiment as shown in FIG. 7, the upper connection part 128 has a dimension at least sufficient to receive a neck 160 of an associated stringed instrument. The securing bar 142 operates in conjunction with string press bar 122 to secure the capo 110 to the neck 160 of an associated stringed instrument. Additionally, the dimension and shape of securing bar 142 facilitates the secure attachment of the capo 110 to the neck 160 of an associated stringed instrument. In this example, the securing bar 142 is narrower than the string press bar 122 and the string press bar 122 extend beyond the securing bar 142 in at least one direction generally perpendicular to the clamping direction of the capo.

In using the capo 110, the musician grasps the handles of the upper and lower handles 126 and 146, which are connected to the string press bar 122 and securing bar 142 respectively. The upper handle 126 and the lower handle 146 may be squeezed together against the force of the spring 114 to open the capo 110 to receive the neck 160 of an instrument. The capo 110 is then moved to receive the neck 160 of the instrument, which is caused to move into the gap with the upper arm member 120, string press bar 122 and upper pad 124 positioned above the strings 162 of the guitar. The manual pressure of the musician's hand on the upper handle 126 and the lower handle 146 is then released, allowing the spring 114 to urge the string press bar 122 and the securing bar 142 into an abutting relation with opposing surfaces of the neck 160. At least one of the strings 162 is forced into engagement with the fret board 164 of the guitar. Due to the physical properties of the pads 124 and 144, which may be elastomeric pads, the capo 110 is prevented from sliding off the neck.

When it is desired to reposition the capo 110 along the neck 160 of an associated stringed instrument, or to remove the capo 110 from the neck 160, the musician grasps the handles of the upper and lower handles 126 and 146, which are connected to the string press bar 122 and securing bar 142 respectively. The upper handle 126 and the lower handle 146 may be squeezed together against the force of the spring 114 to open the capo 110 and cause the string press bar 122 and securing bar 142 to move to a release position. As illustrated in FIG. 7, when in use, the offset between the string press bar 122 and the securing bar 142, due to the securing bar 142 being narrower than the string press bar 122 or the string press bar 122 extending beyond the securing bar 142, provides for space for the musicians thumb as not to require awkward positing around the capo 110.

Figure 8:
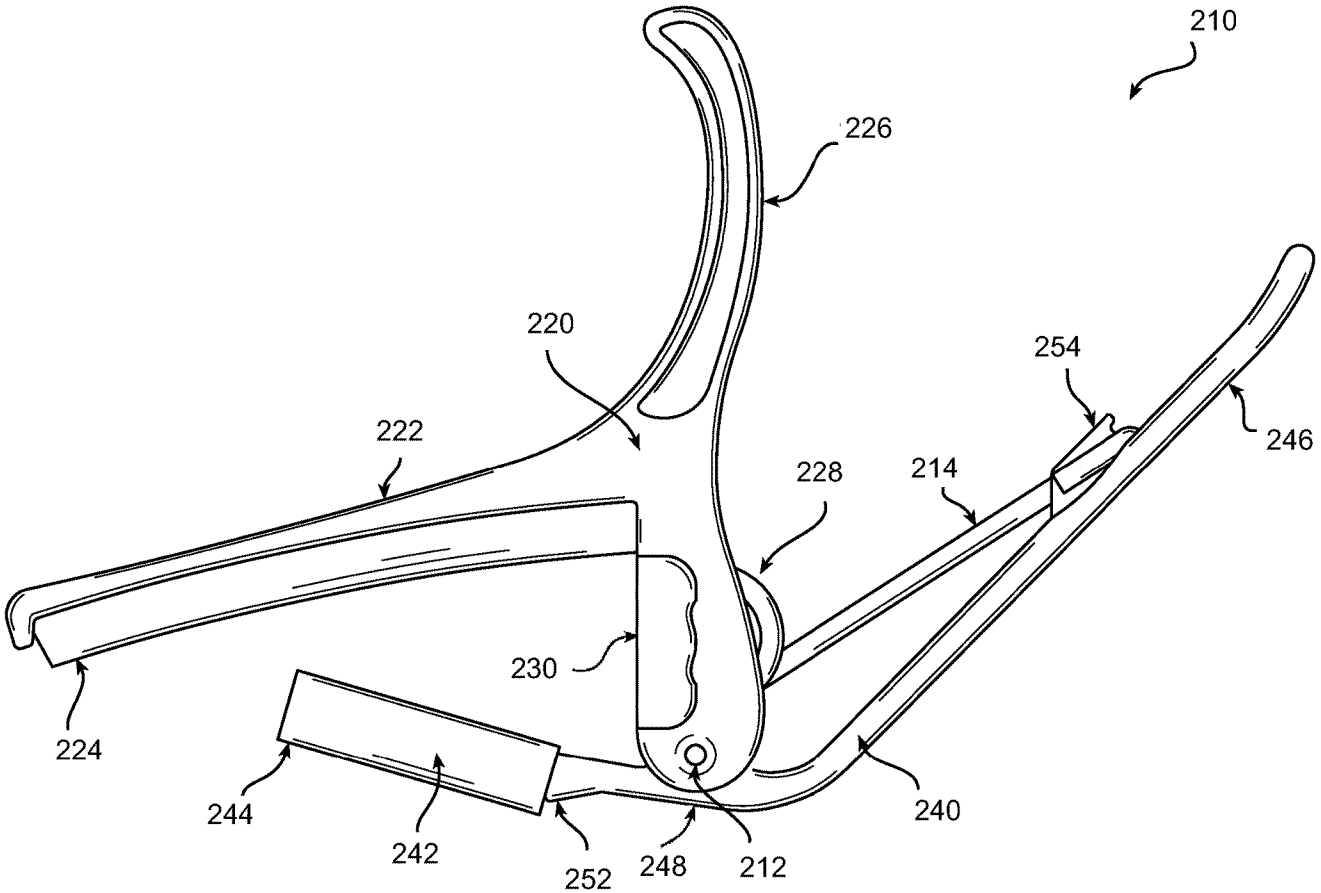
FIG. 8 is a side elevation of the capo of FIG. 2.

With reference to FIG. 8, an alternate embodiment of capo 110 is presented. Similar reference numbers are used to denote elements related to those presented in FIGS. 2-7. In this embodiment the upper arm extension member 228 does not extend to completely cover any spring coils of spring 214.

Figure 9:
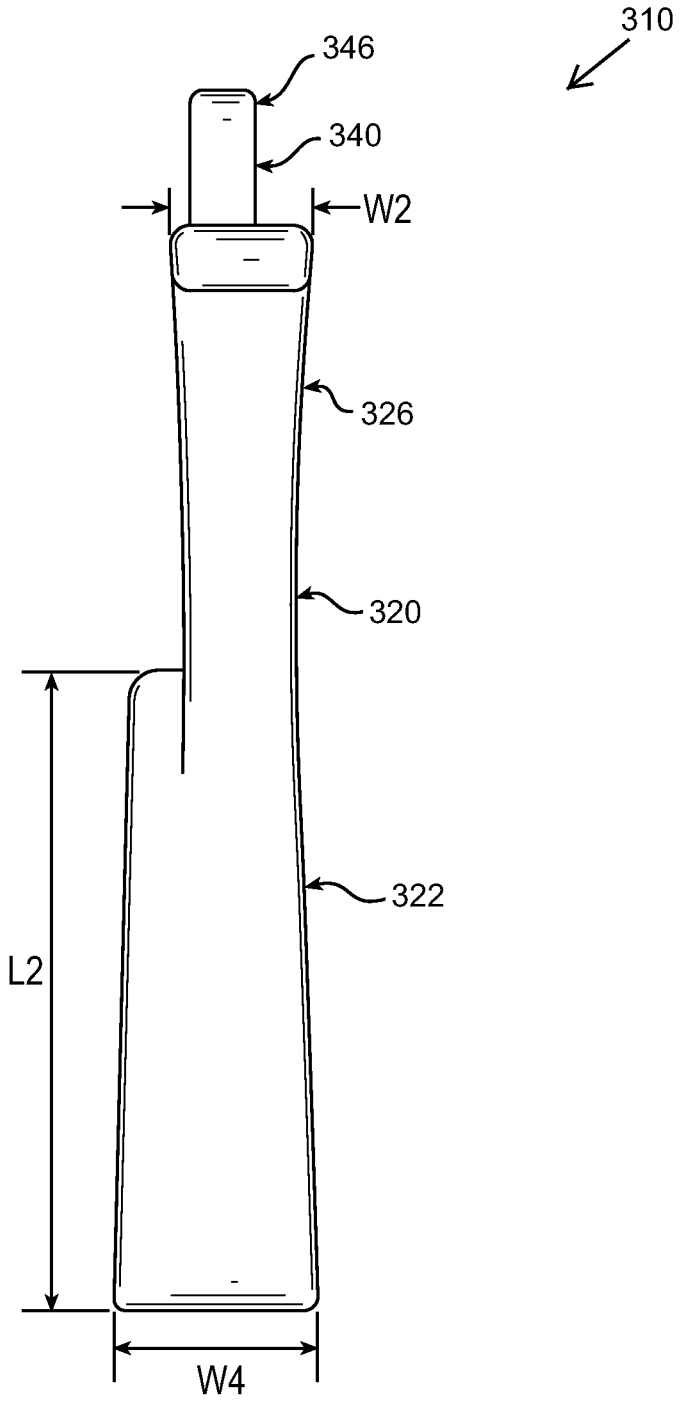
FIG. 9 is a top perspective view of the capo of FIG. 4.

With reference to FIG. 9, an alternate embodiment of capo 110 is presented. Similar reference numbers are used to denote elements related to those presented in FIGS. 2-7. In this embodiment, the upper arm member 320 is shown with its width W4 and W2 varied along is length.

Figure 10:
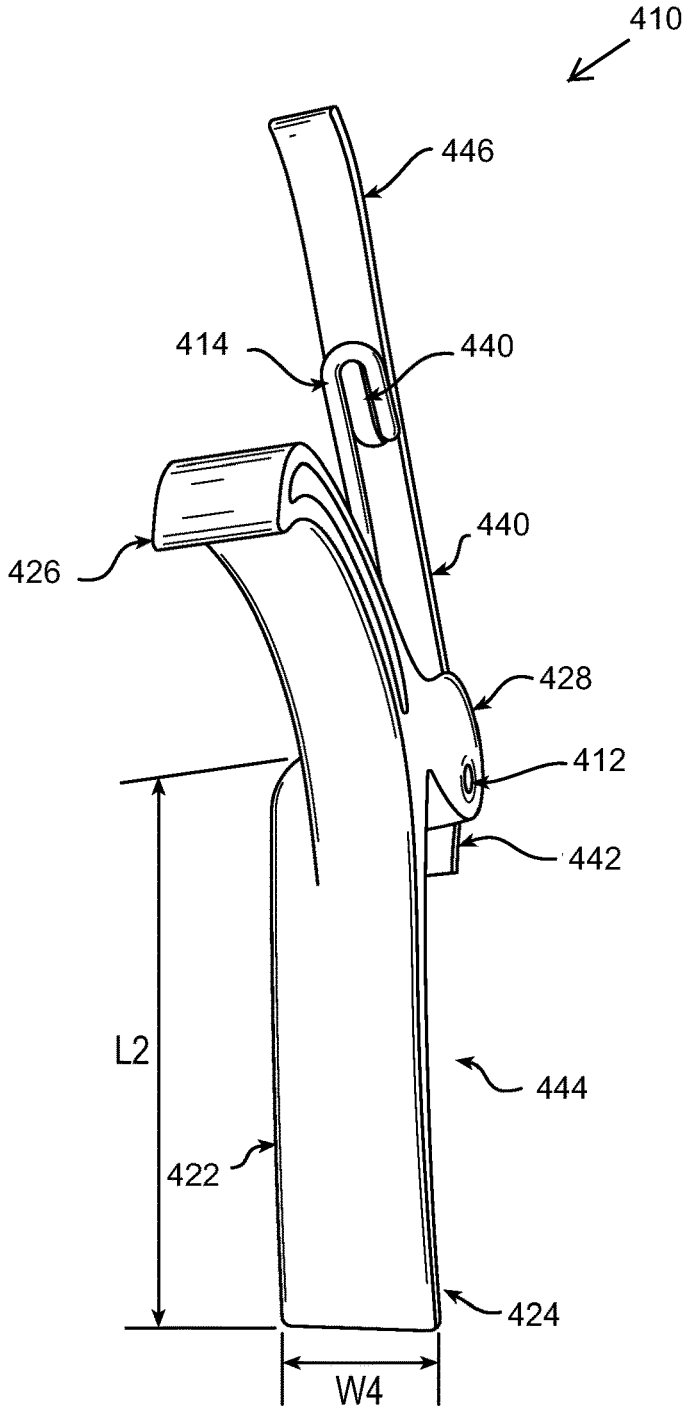
FIG. 10 is a side perspective view of the capo of FIG. 4.

With reference to FIG. 10, an alternate embodiment of capo 110 is presented. Similar reference numbers are used to denote elements related to those presented in FIGS. 2-7. In this embodiment, the string press bar 422 has a downward concave curvature, and the upper handle 426 has a flared end to promote a secure grip of the upper handle 426 during the use of capo 410.

The foregoing has been described in what is considered to represent its preferred embodiment. However, it should be understood that it may be practiced otherwise than as specifically illustrated and described without departing from its spirit or scope.

What is claimed is:

1. A capo for use with a stringed instrument, said capo comprising:

a string press bar for engaging the strings of the stringed instrument; and an upper connection part transverse to the spring press bar, wherein a width of the upper connection part is narrower than a width of the spring press bar.

2. The capo of claim 1 further comprising a securing bar to engage a neck of said stringed instrument.

3. The capo of claim 2 further comprising a lower pad attached to said securing bar.

4. The capo of claim 2, wherein said securing bar has a pad stop.

5. The capo of claim 3, wherein said securing bar has a plurality of ribs to assist in attaching said lower pad.

6. The capo of claim 2, wherein said string press bar is connected to an upper connection part.

7. The capo of claim 6, wherein said securing bar is connected to a lower connection part.

8. The capo of claim 7, wherein said upper connection part and said lower connection part are connected by a pivot.

9. The capo of claim 8, wherein said pivot is a rivet.

10. The capo of claim 6, wherein said upper connection part has a dimension at least sufficient to facilitate acceptance of a neck of an associated stringed instrument.

11. The capo of claim 2, wherein the securing bar is narrower than the string press bar.

12. A capo for use with a stringed instrument, said capo comprising:

a string press bar for engaging the strings of the stringed instrument; and a securing bar to engage a neck of said stringed instrument, the securing bar being narrower than the string press bar creating an offset between the string press bar and the securing bar.

13. The capo of claim 12 further comprising an upper connection part and a lower connection part, the upper connection part and the lower connection part attaching at a connection point.

14. The capo of claim 13, wherein said connection point is a pivot point.

15. The capo of claim 14, wherein said pivot point is a rivet.

16. The capo of claim 13, wherein the connection point is formed by the nesting of said upper connection part and said lower connection part.

17. The capo of claim 12, further comprising a lower pad removably attached to said securing bar.

18. The capo of claim 12, further comprising a pad stop attached to the securing bar.

19. The capo of claim 12, further comprising a plurality of ribs attached to said securing bar.

* * * * *